US008752373B2

(12) United States Patent
Yamashita et al.

(10) Patent No.: US 8,752,373 B2
(45) Date of Patent: Jun. 17, 2014

(54) SLEWING TYPE WORKING MACHINE

(75) Inventors: Koji Yamashita, Hiroshima (JP); Koji Ueda, Hiroshima (JP); Masayuki Komiyama, Hiroshima (JP); Yoichiro Yamazaki, Hiroshima (JP); Yusuke Kamimura, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 14/007,873

(22) PCT Filed: Apr. 19, 2012

(86) PCT No.: PCT/JP2012/002723
§ 371 (c)(1),
(2), (4) Date: Sep. 26, 2013

(87) PCT Pub. No.: WO2012/150652
PCT Pub. Date: Nov. 8, 2012

(65) Prior Publication Data

US 2014/0007565 A1 Jan. 9, 2014

(30) Foreign Application Priority Data

May 2, 2011 (JP) ..... 2011-103058
May 11, 2011 (JP) ..... 2011-106184
May 16, 2011 (JP) ..... 2011-109742

(51) Int. Cl.
*F16D 31/02* (2006.01)

(52) U.S. Cl.
USPC ..... 60/468; 60/493

(58) Field of Classification Search
USPC ..... 60/414, 436, 441, 442, 468, 469, 493, 60/494
See application file for complete search history.

(56) References Cited

U.S. PATENT DOCUMENTS 5,063,742 A * 11/1991 Yoshimatsu ..... 60/466
5,211,015 A * 5/1993 Schroeder ..... 60/444
(Continued)

FOREIGN PATENT DOCUMENTS

JP 8 200305 8/1996
JP 2005 344431 12/2005
(Continued)

OTHER PUBLICATIONS

International Search Report Issued Jul. 31, 2012 in PCT/JP12/002723 Filed Apr. 19, 2012.
Japanese Office Action Issued Jul. 24, 2012 in JP Patent Application No. 2011-103058 Filed May 2, 2011(with English translation).

*Primary Examiner* — Edward Look
*Assistant Examiner* — Michael Quandt
(74) *Attorney, Agent, or Firm* — Oblon, Spivak, McClelland, Maier & Neustadt, L.L.P.

(57) ABSTRACT

A slewing-type working machine, including a base, an upper slewing body, a hydraulic motor slewing the upper slewing body, a hydraulic pump, a slewing operation device, a control valve controlling the hydraulic motor, pipe-lines connecting the hydraulic motor to the control valve, a hydraulic pressure source, communication valves switching communication and cutoff between the pipe-lines and a tank by pilot pressure, an electric motor, an electric storage device, communication selector valves on inlet sides of the communication valves, a switching control valve on an inlet side of the communication selector valves, and a controller. During slewing deceleration, the controller signals to switch the switching control valve to a connecting position and switch the communication selector valves to a pilot pressure supply position. In a slewing stopped state, the controller signals to switch the communication selector valves to a cutoff position and switch the communication valves to a communication cutoff position.

7 Claims, 4 Drawing Sheets

(56) References Cited

U.S. PATENT DOCUMENTS

| | | | | |
|---|---|---|---|---|
| 5,636,516 | A * | 6/1997 | Kon | 60/466 |
| 6,145,312 | A * | 11/2000 | Hauser et al. | 60/464 |
| 6,732,513 | B2 * | 5/2004 | Tajima | 60/468 |
| 6,962,050 | B2 * | 11/2005 | Hiraki et al. | 60/414 |
| 7,111,458 | B2 * | 9/2006 | Gandrud | 60/464 |

FOREIGN PATENT DOCUMENTS

| | | |
|---|---|---|
| JP | 2010 65510 | 3/2010 |
| JP | 2012 127123 | 7/2012 |

* cited by examiner

SLEWING TYPE WORKING MACHINE

TECHNICAL FIELD

The present invention relates to a slewing-type working machine such as an excavator.

BACKGROUND ART

The background art of the present invention will be described using an excavator as an example.

For example, as shown in FIG. 3, a general excavator comprises a crawler-type base carrier 1, an upper slewing body 2 mounted on the base carrier 1 so as to be capable of slewing around an axis X perpendicular to the ground, and an excavating attachment 3 attached to the upper slewing body 2. The excavating attachment 3 includes: a boom 4 capable of being raised and lowered; an arm 5 attached to a tip of the boom 4; a bucket 6 attached to a tip of the arm 5; and a boom cylinder 7, an arm cylinder 8, and a bucket cylinder 9 which are respective cylinders (hydraulic cylinders) for actuating the boom 4, the arm 5, and the bucket 6.

FIG. 4 shows an example of a conventional hydraulic circuit for slewing the upper slewing body 2. The circuit includes: a hydraulic pump 10 as a hydraulic pressure source that is driven by an engine not graphically shown; a slewing hydraulic motor 11 which is rotated by hydraulic pressure supplied from the hydraulic pump 10 to drive the upper slewing body 2 to slew it; a remote-control valve 12 as a slewing operation device including a lever 12*a* to which an operation is applied to input a command for the slewing; and a control valve 13 which is a pilot operated selector valve that can be operated by the remote-control valve 12 and provided between the hydraulic motor 11*a* and a pair of the hydraulic pump 10 and a tank T.

The lever 12*a* of the remote-control valve 12 is operated between a neutral position and right and left slewing positions, and the remote-control valve 12 outputs a pilot pressure with a magnitude corresponding to an operation amount of the lever 12*a* from a port corresponding to an operation direction of the lever 12*a*. The control valve 13 is switched from a graphically shown neutral position 13*a* to a left slewing position 13*b* or a right slewing position 13*c* by the pilot pressure, thereby controlling respective directions of supply of the hydraulic fluid to the hydraulic motor 11 and of right and left discharge of the hydraulic fluid from the hydraulic motor 11, and a flow rate of the hydraulic fluid. In other words, performed are: switching slewing state, that is, selectively switching to respective states of acceleration (including start-up), steady operation at a constant speed, deceleration, and stop; and controlling slewing direction and slew speed.

The control valve 13 and respective right and left ports of the hydraulic motor 11 are interconnected through a right slewing pipe-line 15 and a left slewing pipe-line 14. Between both slewing pipe-lines 14 and 15, provided are a relief valve circuit 18, a check valve circuit 21, and a communication path 22. The relief valve circuit 18 is provided so as to interconnect the slewing pipe-lines 14 and 15, and the relief valve circuit 18 is provided with a pair of relief valves 16 and 17 having respective outlets which are opposed and connected to each other. The check valve circuit 21 is provided so as to interconnect the slewing pipe-lines 14 and 15 at a position closer to the hydraulic motor 11 than the relief valve circuit 18, and the check valve circuit 21 is provided with a pair of check valves 19 and 20 having respective inlets which are opposed and connected to each other. The communication path 22 interconnects a first portion of the relief valve circuit 18, the first portion located between both relief valves 16 and 17, and a second portion of the check valve circuit 21, the second portion located between both check valves 19. The communication path 22 is connected to the tank T through a make-up line 23 for sucking up hydraulic fluid, and the make-up line 23 is provided with a back pressure valve 24.

In this circuit, when the remote-control valve 12 is not operated, that is, when the lever 12*a* thereof is at a neutral position, the control valve 13 is kept at the neutral position 13*a*; when the lever 12*a* of the remote-control valve 12 is operated to the left or the right from the neutral position, the control valve 13 moves from the neutral position 13*a* to the left slewing position 13*b* or the right slewing position 13*c* in accordance with an operating direction of the lever 12*a*, by a stroke in accordance with an operation amount of the lever 12*a*.

At the neutral position 13*a*, the control valve 13 blocks both slewing pipe-lines 14 and 15 from the pump 10 to prevent the hydraulic motor 11 from rotation; when switched to the left slewing position 13*b* or the right slewing position 13*c*, the control valve 13 allows hydraulic fluid from the pump 10 to be supplied to the left slewing pipe-line 14 or the right slewing pipe-line 15 to thereby bring the hydraulic motor 11 into a slewing-driving state of leftward or rightward rotating to slew the upper slewing body 2. The slewing-driving state includes both an accelerative slewing state including start-up and a steady operation state at a constant rotational speed. Meanwhile, the fluid discharged from the hydraulic motor 11 is returned to the tank T via the control valve 13.

Next will be described deceleration of slewing. For example, in the rightward slewing, i.e., clockwise slewing, upon a deceleration operation applied to the remote-control valve 12, specifically, upon an operation for returning the lever 12*a* to the neutral position or to the side of the neutral position, the control valve 13 is operated to the side of returning to the neutral position 13*a* to stop the supply of hydraulic fluid to the hydraulic motor 11 and the return of hydraulic fluid from the hydraulic motor 11 to the tank T, or to reduce a supply flow rate and a return flow rate of the hydraulic fluid. Meanwhile, the hydraulic motor 11 continue its clockwise rotation due to the inertia of the upper slewing body 2, thus raising pressure in the left slewing pipe-line 14 as a meter-out-side line. When the raised pressure reaches a certain value, the relief valve 16 on the left side in the diagram is opened to allow hydraulic fluid in the left slewing pipe-line 14 to flow into the hydraulic motor 11 through the relief valve 16, the communication path 22, the check valve 20 on the right side in the diagram, and the right slewing pipe-line 15 as indicated by a dashed-line arrow in FIG. 4. This gives a braking force due to the action of the relief valve 16 against the hydraulic motor 11 which continues to rotate due to the inertia, thereby decelerating and stopping the hydraulic motor 11. Decelerating and stopping the leftward slewing are similarly performed. On the other hand, when the slewing pipe-line 14 or 15 is subjected to negative pressure during the deceleration, the hydraulic fluid in the tank T is sucked up into the slewing pipe-line 14 or 15 through the make-up line 23, the communication path 22 and the check valve circuit 21, thereby preventing cavitation.

Japanese Patent Application Laid-open No. 2010-65510 discloses an excavator including a circuit as shown in FIG. 4 described above, the excavator further including: a slewing electric motor connected to the hydraulic motor 11; a direct-interconnection selector valve switchable between a direct-interconnection position for directly interconnecting the left and right pipe-lines 14 and 15 and a cutoff position for cutting off the direct interconnection; an electric storage device; and a controller which switches the direct-interconnection selector valve to the direct-interconnection position during slewing deceleration to return motor-discharged fluid to a motor inlet-side and cause the slewing electric motor to perform an electric motor action, wherein the electric storage device stores regenerative power generated by the electric motor action. With this technique, the direct-interconnection selector valve reduces back pressure that acts on a motor outlet-side during slewing deceleration to reduce drag load of the hydraulic motor. This allows efficiency of recovery (in other words, regeneration) of inertial kinetic energy to be improved.

Although the known art described in Japanese Patent Application Laid-open No. 2010-65510 uses a solenoid selector valve as the bypass selector valve, there may be cases where the motor load is required to be reduced by use of not a solenoid selector valve but a hydraulic-pilot-controlled selector valve, for example, in the case of a relatively large flow rate or in the case of requiring an absorption of a shock produced by switching. In such a case, in order to electrically switch the hydraulic-pilot-controlled selector valve, provided are a communication selector valve constituted by a separate solenoid selector valve between a pilot port of the hydraulic-pilot-controlled selector valve and a hydraulic pilot pressure source; the communication selector valve is opened and closed, thus allowing turning on and off the input of the pilot pressure to the hydraulic-pilot-controlled selector valve to be performed.

However, in this case, if a phenomenon such as fixation of a spool of the communication selector valve or the like occurs and causes such a failure that the communication selector valve is prevented from a movement from a pilot pressure supply position, there may be continued a state where pilot pressure is supplied to the hydraulic-pilot-controlled selector valve even after slewing has stopped. Hence, for example, in the case where the direct-interconnection selector valve is made up of the hydraulic-pilot-controlled selector valve, the direct-interconnection selector valve is brought into a state of directly interconnecting both of the pipe-lines, which makes it impossible to prevent the hydraulic motor and the upper slewing body connected thereto from rotation. This generates a fear of allowing an upper slewing body to slew due to its own weight on inclined ground or the like.

Patent Document 1: Japanese Patent Application Laid-open No. 2010-65510

SUMMARY OF THE INVENTION

An object of the present invention is to provide a slewing-type working machine which is capable of improving energy recovery efficiency by reducing motor load at least during slewing deceleration, by use of a hydraulic-pilot-controlled selector valve and a communication selector valve for switching supply of pilot pressure to the hydraulic-pilot-controlled selector valve and which is capable of holding an upper slewing body in a stopped state even when a failure attributable to fixation of a spool or the like of the communication selector valve occurs. The slewing-type working machine provided by the present invention includes: a base carrier; an upper slewing body mounted on the base carrier so as to be capable of being slewed; a hydraulic motor which includes first and second ports and which receives supply of hydraulic fluid through one of the first and second ports and discharges the hydraulic fluid through the other port to thereby operate so as to drive the upper slewing body to slew it; a hydraulic pump which discharges the hydraulic fluid to be supplied to the hydraulic motor; a first pipe-line a second pipe-line; a slewing operation device including an operating member to which an operation is applied to input a command for the driving to slew and being adapted to output an operation signal corresponding to the operation applied to the operating member; a control valve connected to the first port and the second port of the hydraulic motor through the first pipe-line and the second pipe-line, respectively, the control valve being adapted to be operated, based on the operation signal from the slewing operation device, to control supply of hydraulic fluid to the hydraulic motor and control discharge of hydraulic fluid from the hydraulic motor and adapted to be held at a neutral position for cutting off both the first and second pipe-lines from the hydraulic pump and the tank when the operation signal is absent; a communication valve which comprises a hydraulic-pilot-controlled selector valve having a pilot port, the communication valve being adapted to be switched to a communication position for bringing a pipe-line corresponding to an outlet-side pipe-line that is the pipe-line on an outlet-side of the hydraulic motor of the first and second pipe-lines into direct communication with the tank while bypassing the control valve or communication with an inlet-side pipe-line that is the pipe-line on an inlet-side of the motor of the first and second pipe-lines when pilot pressure is supplied to the pilot port, while the communication valve being held at a communication cutoff position for cutting off the communication when the pilot pressure is not supplied to the pilot port; a hydraulic pilot pressure source which generates pilot pressure to be supplied to the communication valve; a communication selector valve which is provided on a pilot line for supplying pilot pressure from the hydraulic pilot pressure source to the pilot port of the communication valve and which is switched between a supply position for allowing the pilot pressure to be supplied to the communication valve and a position for cutting off the supply of the pilot pressure; a switching control valve which is provided on an inlet side of the communication selector valve and which is switched between a connecting position for connecting the hydraulic pilot pressure source to the communication selector valve and a cutoff position for cutting off the connection; and a controller which issues commands to the communication selector valve and the switching control valve for switching respective position of the communication selector valve and the switching control valve, wherein: at least during slewing deceleration, the controller issues a command to switch the switching control valve to the connecting position and a command to switch the communication selector valve to the supply position, thereby permitting the pilot pressure to be supplied to the pilot port of the communication valve to set the communication valve to the communication position; and, in a state where the slewing is stopped, the controller issues a command to switch the communication selector valve to the cutoff position and issues a command to switch the switching control valve to the cutoff position so as to bring the communication valve into the communication cutoff position regardless of an actual position of the communication selector valve.

EMBODIMENT FOR CARRYING OUT THE INVENTION

Figure 3:
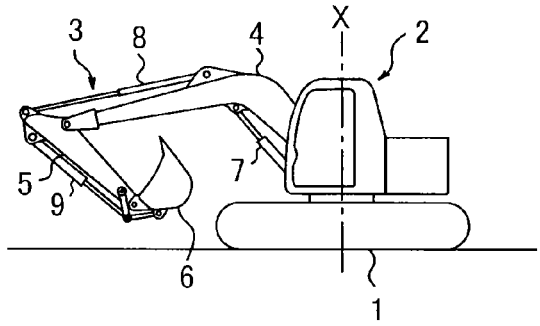
FIG. 3 is a side view showing a general excavator.
Figure 4:
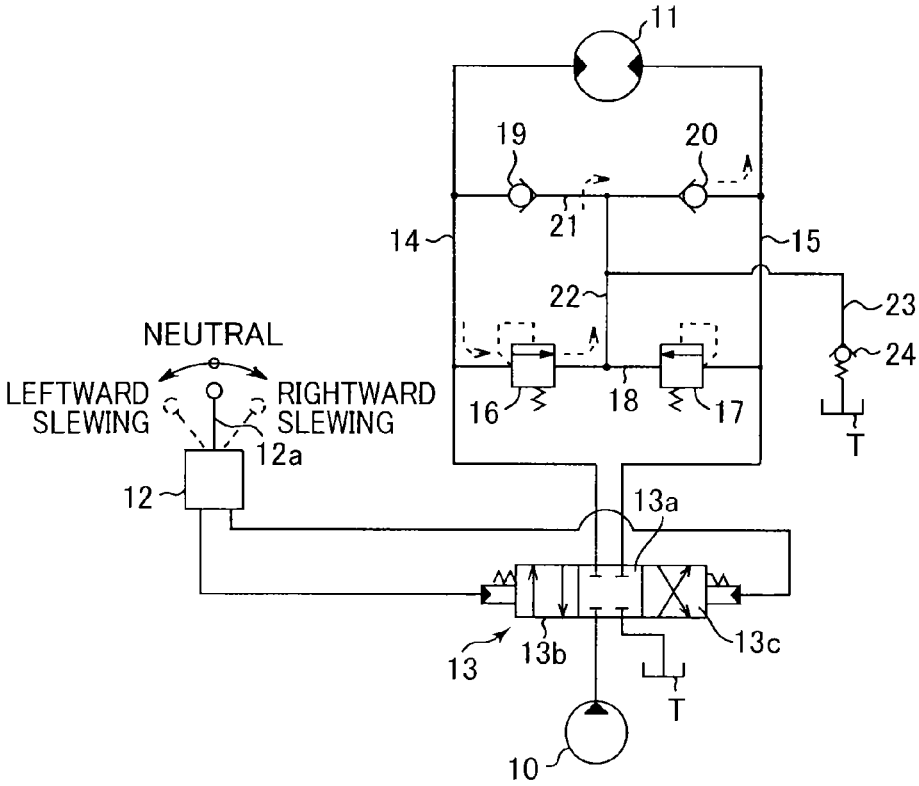
FIG. 4 is a diagram showing an example of a hydraulic circuit mounted to a conventional work machine.

There will be described embodiments of the present invention. The embodiments are applied to the excavator shown in FIG. 3, similarly to the above-described background art.

Figure 1:
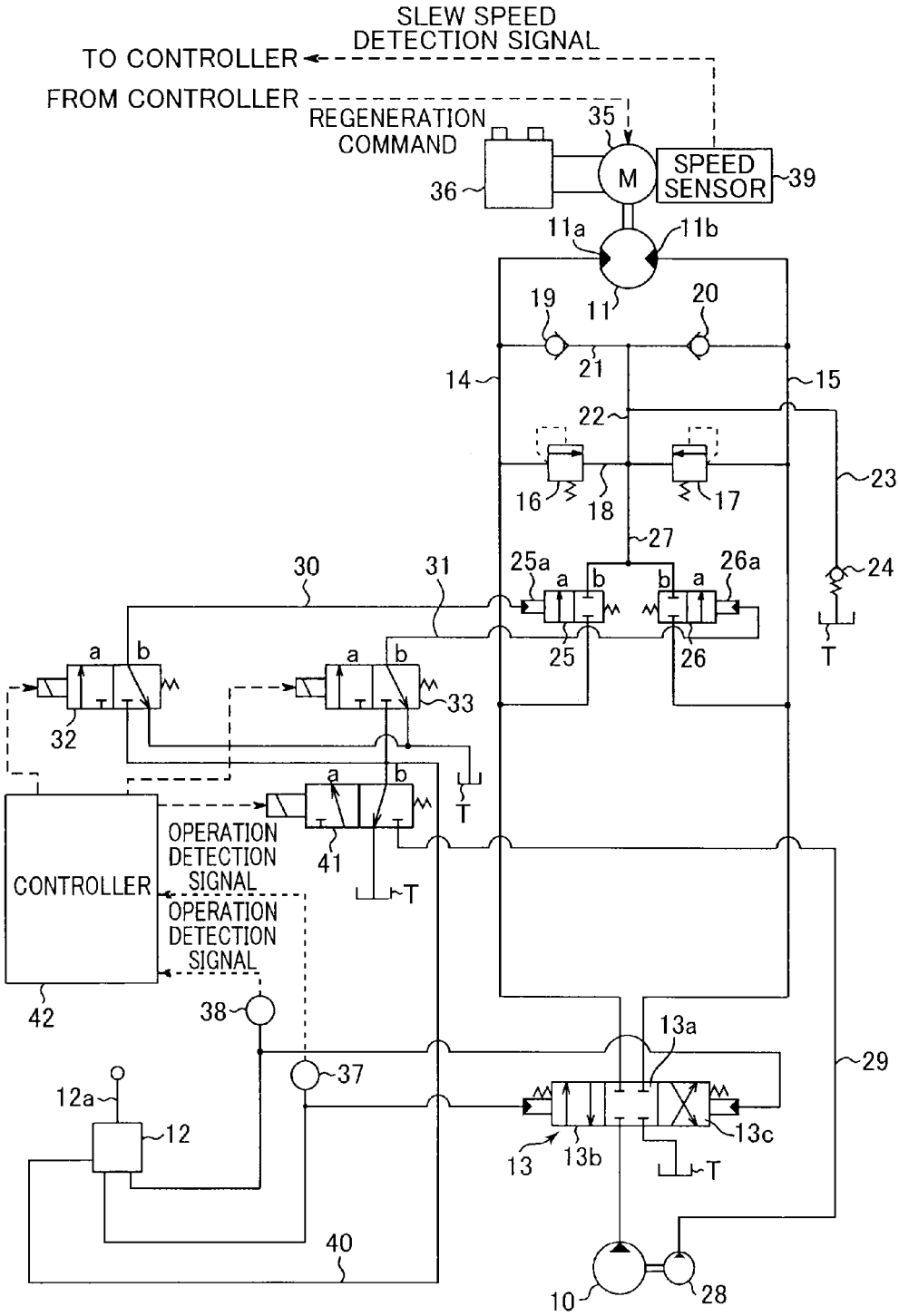
FIG. 1 is a diagram showing a hydraulic circuit according to a first embodiment of the present invention.

FIG. 1 shows a hydraulic circuit according to the first embodiment of the present invention. The circuit includes: a hydraulic pump 10 as a hydraulic pressure source, which is driven by an engine not graphically shown; a slewing hydraulic motor 11 which is rotated by supply of hydraulic fluid discharged from the hydraulic pump 10 to drive the upper slewing body 2 to slew it, a remote-control valve 12 as a slewing operation device including a lever 12*a* to which an operation is applied to input a slewing command; and a control valve 13 which is a pilot-controlled selector valve capable of being operated by the remote-control valve 12 and is provided between the hydraulic motor 11 and a pair of the hydraulic pump 10 and a tank T.

The hydraulic motor 11 includes a left port 11*a* and a right port 11*b* which are first and second ports, respectively. When supplied with hydraulic fluid through the left port 11*a*, the hydraulic motor 11 discharges the hydraulic fluid through the right port 11*b* to leftward slew the upper slewing body 2 shown in FIG. 3. Conversely, when supplied with hydraulic fluid through the right port 11*b*, the hydraulic motor 11 discharges the hydraulic fluid through the left port 11*a* to rightward slew the upper slewing body 2.

The lever 12*a* of the remote-control valve 12 is operated between a neutral position and right and left slewing positions, and the remote-control valve 12 outputs pilot pressure with a magnitude corresponding to an operation amount of the lever 12*a* from a port corresponding to an operation direction of the lever 12*a*. The control valve 13 is switched from a graphically shown neutral position 13*a* to a left slewing position 13*b* or a right slewing position 13*c* by the pilot pressure, thereby controlling respective directions of supply of the hydraulic fluid to the hydraulic motor 11 and of right and left discharge of the hydraulic fluid from the hydraulic motor 11, and a flow rate of the hydraulic fluid. In other words, performed are: switching slewing state, that is, selectively switching to respective states of acceleration (including start-up), steady operation at a constant speed, deceleration, and stop; and controlling slewing direction and slew speed.

The circuit includes a left slewing pipe-line 14 and a right slewing pipe-line 15 which are the first and second pipe-lines, respectively, a relief valve circuit 18, a check valve circuit 21, a communication path 22, and a make-up line 23.

The left slewing pipe-line 14 connects the control valve 13 to the left port 11*a* of the hydraulic motor 11, and the right slewing pipe-line 15 connects the control valve 13 to the right port 11*b* of the hydraulic motor 11. The control valve 13 is adapted: to cut off both left and right pipe-lines 14 and 15 from the hydraulic pump 10 and the tank T to stop the flow of the hydraulic fluid, at the neutral position 13*a*; to connect the hydraulic pump 10 to the left slewing pipe-line 14 and bring the right slewing pipe-line 15 into communication with the tank, at the left rotational position 13*b*; and to connect the hydraulic pump 10 to the right slewing pipe-line 15 and bring the left slewing pipe-line 14 into communication with the tank, at the right rotational position 13*c*.

The relief valve circuit 18, the check valve circuit 21, and the communication path 22 are provided between the slewing pipe-lines 14 and 15.

The relief valve circuit 18 is provided so as to interconnect the slewing pipe-lines 14 and 15. The relief valve circuit 18 includes a pair of relief valves 16 and 17 having respective outlets which are opposed and connected to each other.

The check valve circuit 21 is arranged parallel to the relief valve circuit 18 at a position closer to the hydraulic motor 11 than the relief valve circuit 18 so as to interconnect the slewing pipe-lines 14 and 15. The check valve circuit 21 includes a pair of check valves 19 and 20 having respective inlets of the check valves 19 and 20 which are opposed and connected to each other.

The communication path 22 interconnects a first portion of the relief valve circuit 18, the first portion located between the relief valves 16 and 17, and a second portion of the check valve circuit 21, the second portion located between the check valves 19 and 20. The makeup line 23 connects the communication path 22 to the tank T in order to suck up hydraulic fluid. The makeup line 23 is provided with a back pressure valve 24.

The circuit according to the first embodiment further includes: a left communication valve 25 and a right communication valve 26 which are respective first communication valve and second communication valve; a pilot pump 28; a left communication selector valve 32 and a right communication selector valve 33 which are respective first communication selector valve and the second communication selector valve provided for the left and right communication valves 25 and 26, respectively; a slewing electric motor 35 capable of being rotationally driven by the hydraulic motor 11; an electric storage device 36; pressure sensors 37 and 38 which are respective operation detectors; a speed sensor 39 which is a speed detector; a lock valve 41; and a controller 42.

The communication valves 25 and 26 comprise respective hydraulic-pilot-controlled selector valves having respective pilot ports 25*a* and 26*a*. Each of the communication valve 25 and 26, when pilot pressure is supplied to the pilot port thereof, is switched to a communication position "a" for brining the pipe-line corresponding to the communication valve of the pipe-lines 14 and 15 into communication with the tank T; each of the communication valve 25 and 26, when no pilot pressure is supplied to the pilot port thereof, is switched to a communication cutoff position "b" for cutting off the pipe-line from the tank T. The communication valves 25 and 26 include respective inlet-side ports connected to the slewing pipe-lines 14 and 15 and respective outlet-side ports connected via a passage 27 to a part of the relief valve circuit 18, the part located between the relief valves 16 and 17. Since the connected part of the relief valve circuit 18 is connected to the tank T via the communication path 22 and the makeup line 23 as described earlier, the respective slewing pipe-lines 14 and 15 are brought into direct communication with the tank T while bypassing the control valve 13 when the respective communication valves 25 and 26 are set to the open position "a".

The pilot pump 28 is a pilot pressure hydraulic source which generates pilot pressure to be supplied to the communication valves 25 and 26, while being also used, in the present embodiment, as a hydraulic pressure source which supplies inlet pilot pressure to the remote-control valve 12. In other words, the pilot pressure generated by the pilot pump 28 can be supplied to the communication valves 25 and 26 via a pilot line and can also be supplied to the remote-control valve 12 as inlet pilot pressure thereof. Specifically, the pilot line includes a pilot pump line (hydraulic-pilot-pressure-source line) 29 which is a discharge line connected to a discharge side of the pilot pump 28, and a plurality of lines branching parallel to each other from the pilot pump line 29, namely: a first-communication-valve pilot line 30, a second-communication-valve pilot line 31, and a remote-control-valve inlet pressure line 40. The first and second-communication-valve pilot lines 30 and 31 are connected to the pilot ports 25*a* and 26*a* of the left and right communication valves 25 and 26, respectively, and the remote-control-valve-inlet-pressure line 40 is connected to an inlet side of the remote-control valve 12.

The left and right communication selector valves 32 and 33, which are to switch the supply of pilot pressure to the communication valves 25 and 26, in other words, to control switching of the communication selector valves 32 and 33, are provided midway the first and second-communication-valve pilot lines 30 and 31, respectively. The communication selector valves 32 and 33 have respective pilot pressure supply positions "a" for allowing the pilot pressure from the pilot pump 28 to be supplied to the communication valves 25 and 26 and respective pilot pressure cutoff positions "b" for cutting off the supply of the pilot pressure. The communication selector valves 32 and 33 are set to the pilot pressure supply position "a" only upon input of a switching command signal outputted from the controller 42 as will be described later.

The pressure sensors 37 and 38 detect the operations applied to the remote-control valve 12 through respective pilot pressures outputted from the remote-control valve 12, in other words, detect whether the lever 12*a* is located at the neutral position or an operation for a leftward slewing or a rightward slewing is applied. Specifically, the pressure sensors 37 and 38 output respective operation signals corresponding to respective pilot pressures outputted from the remote-control valve 12. The speed sensor 39 detects a rotational speed of the slewing electric motor 35, that is, a speed corresponding to a slew speed of the upper slewing body 2, and outputs a slew speed detection signal.

The controller 42, based on the operation detection signal inputted from the pressure sensors 37 and 38 and on the slew speed detection signal inputted from the speed sensor 39, judges whether the upper slewing body 2 is being driven for slewing (accelerating including start-up or in steady operation), decelerated, or in a stopped state. Upon judgment that the upper slewing body 2 is being driven for slewing, the controller 42 issues a command for switching only one of the communication valves 25 and 26, the communication valve opposite to the operated communication valve, in other words, the communication valve connected to a pipe-line corresponding to a discharge-side pipe-line of the slewing pipe-lines 14 and 15, to the open position "a" (hereinafter, the communication valve connected to the discharge-side pipe-line will be indicated as a "outlet-side communication valve", which corresponds to, during a rightward slewing, the left communication valve 25 connected to the left slewing pipe-line 14, while corresponds to, during a leftward slewing, the right communication valve 26 that connects to the right slewing pipe-line 15). Specifically, the controller 42 outputs, only to a communication selector valve corresponding to the outlet-side communicating valve (during a rightward slewing, the left communication selector valve 32 which corresponds to the left communicating valve 25, and during a leftward slewing, the right communicating valve 33 that connects to the right communicating valve 26: hereinafter referred to as an "outlet-side communication selector valve"), a switching command signal (a drive signal which excites a solenoid of the outlet-side communication selector valve) to switch the outlet-side communication selector valve to the pilot pressure supply position "a".

Accordingly, hydraulic fluid discharged from the hydraulic motor 11 to the left slewing pipe-line 14 or the right slewing pipe-line 15 during driving for slewing passes through the communication valve 25 or 26 that is connected to the discharge-side pipe-line to be directly returned to the tank T, while bypassing the control valve 13. For example, during the rightward slewing, hydraulic fluid discharged from the hydraulic motor 11 sequentially passes through the left slewing pipe-line 14, the left communication valve 25, the passage 27, the communication path 22, and the make-up line 23 before returning to the tank T. During the driving for slewing, the slewing electric motor 29 is rotated so as to be involved by the hydraulic motor 11. In other words, the slewing electric motor 29 is driven by the hydraulic motor 11.

For example, when an operation in a direction for deceleration in the state of rightward slewing is applied to the lever 12*a* of the remote-control valve 12, in other words, an operation is applied so as to return to the neutral position or so as to approach the neutral position, the hydraulic fluid circulates so as to be returned to the right slewing pipe-line 15 from the communication path 22 through the right check valve 20 of the check valve circuit 21. Meanwhile, the slewing electric motor 35 performs a generator (regenerative) action, based on a regeneration command from the controller 42, thus exerting a braking force against the rotation of the hydraulic motor 11 and transmitting the generated regenerative power to the electric storage device 36 to charge it. The regenerative action causes a brake against the rotation of the hydraulic motor 11 to decelerate/stop the upper slewing body 2. Then, in the slewing stopped state, the controller 42 switches both of the communication selector valves 32 and 33 to the pilot pressure cutoff position "b" to set both of the communication valves 25 and 26 to the communication cutoff position "b". The flow of the fluid in the circuit and the rotation of the hydraulic motor 11 due to the flow are thereby blocked and the upper slewing body 2 is held in a stopped state.

Thus, according to this circuit, during rotational drive such as during acceleration or in a steady operation, the fluid discharged from the hydraulic motor 11 is returned to the tank T by the communication valves 25 and 26 while bypassing the control valve 13, which makes it possible to eliminate the back pressure attributable to a throttle action of the control valve 13. In other words, it is possible to reduce the back pressure acting on the meter-out-side during driving for slewing and thereby reduce meter-in-side pressure to lower pump pressure, which allows power loss of the hydraulic pump to be suppressed to eliminate energy wasting.

Besides, during deceleration, causing the electric motor 35 to perform a regenerative action to regenerate slewing energy as a power for the electric storage device enables efficiency to be improved. In other words, even during deceleration, switching the outlet-side communication valve of the communication valves 25 and 26 to the communication position "a" to bring the outlet-side pipe-line into communication with the tank T makes it possible to secure a regenerative action to obtain an energy saving effect.

Furthermore, the first embodiment includes a not-graphically-shown lock lever which performs opening and closing a gate of the machine and a lock valve 41 as a switching control valve. The lock valve 41 comprises a solenoid selector valve and is provided midway the pilot pump line 29 on an inlet side of the remote-control valve 12 and the communication selector valves 32 and 33. The lock valve 41 is switched, by a switching command signal inputted from the controller 42, between a pilot pressure supply position "a" for opening the pilot pump line 29 to allow the pilot pressure to be supplied (that is, a connection position for connecting the pilot pump 28 to both of the communication selector valves 32 and 33) and a tank communication position "b" for cutting off the pilot pump line 29 in the midway thereof and bringing the respective communication selector valves 32 and 33 and the inlet side of the remote-control valve 12 into communication with the tank T (in other words, a cutoff position for cutting off the pilot pump 28 from both of the communication selector valves 32 and 33).

The excavator according to the first embodiment further comprises a lever detector (not shown) which detects an operation applied to the lock lever in a direction for the opening performed by an operator to exit the excavator and which outputs a detection signal thereof (the detector may be a contact switch such as a limiter switch and a micro switch or a contactless switch such as a photoelectric switch). Based on the detection signal outputted by the lever detector, the controller 42 issues, in a slewing stopped state, a command for making the solenoid of the lock valve 41 be non-excited to switch the lock valve 41 from the pilot pressure supply position "a" to the graphically shown tank communication position "b".

The lock valve 41 thus switched to the tank communication position "b" cuts off the supply of the inlet pilot pressure from the pilot pump 28 to the remote-control valve 12 to make operations applied to the remote-control valve 12 be inoperable, that is, to create a so-called locked state, thus disabling the control valve 13 from being operated, that is, disabling the upper slewing body 2 from slewing, and further bringing respective inlet sides of the communication selector valves 32 and 33 into communication with the tank T to thereby disable the pilot pressure from being supplied to the communication selector valves 32 and 33. Thus, in the first embodiment, the communication-valve pilot lines 30 and 31 are branched in parallel, together with the remote-control-valve-inlet-pressure line 40, on the outlet side of the lock valve 41, and provided with respective communication selector valves 32 and 33; therefore, switching the lock valve 41 to the tank communication position "b" not only makes operations applied to the remote-control valve 12 be inoperable but also disables the pilot pressure from being supplied to the communication valves 25 and 26 through the communication selector valves 32 and 33 regardless of actual positions of the communication selector valves 32 and 33. Hence, even if a situation occurs where the communication selector valves 32 and 33 become immobilized at the pilot pressure supply position "a" due to fixation of a spool or the like, the lock valve 41, in the slewing stopped state, prevents pilot pressure from being supplied to the communication valves 25 and 26, thereby reliably holding each of the communication valves 25 and 26 at the communication cutoff position "b" to prevent the hydraulic motor 11 from rotation.

Figure 5:
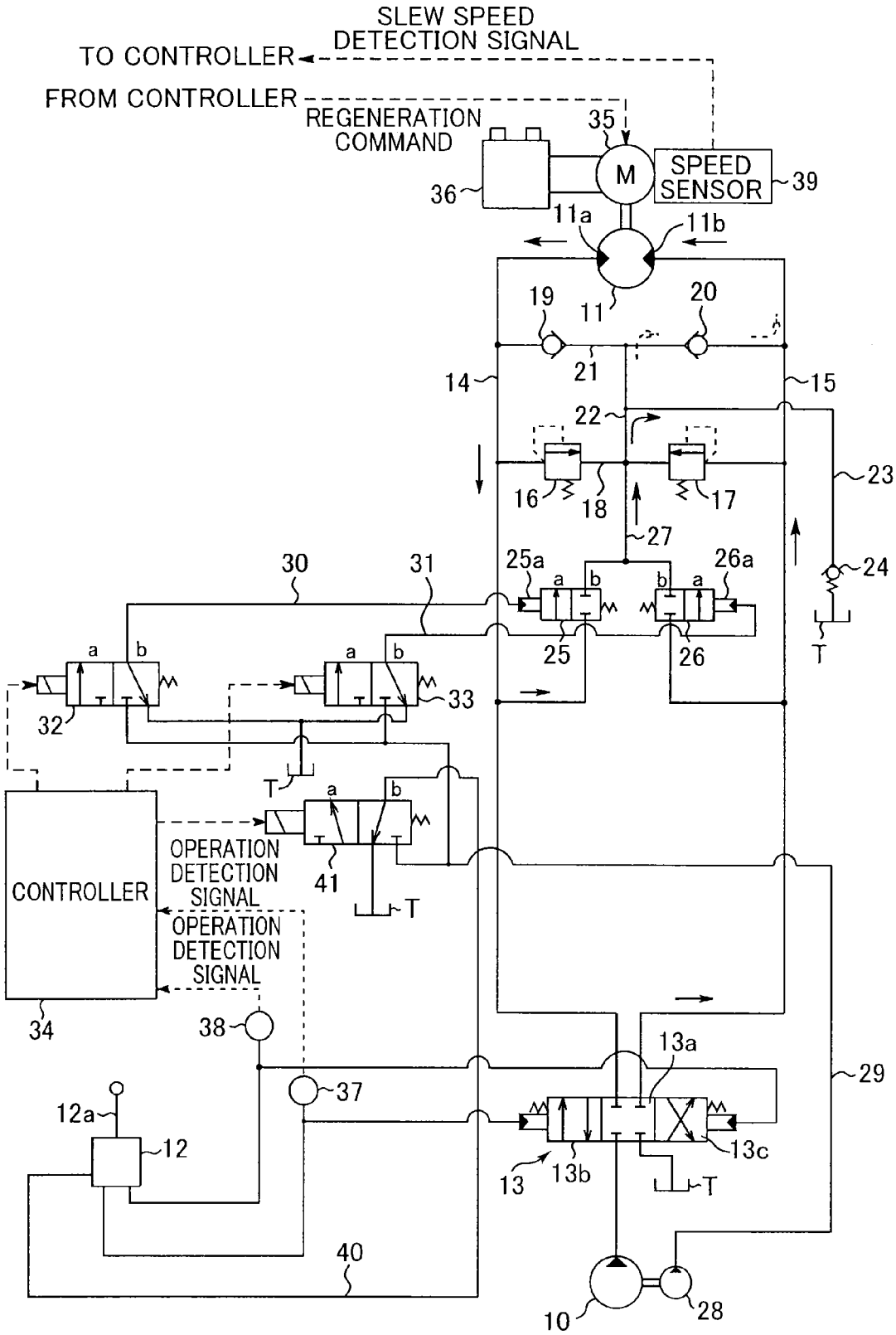
FIG. 5 is a diagram showing a hydraulic circuit according to a comparative example of the present invention.

The effect of the first embodiment will be described through a comparison with a circuit shown in FIG. 5 as a comparative example. Although the circuit shown in FIG. 5 also comprises a lock valve 41 similarly to the circuit shown in FIG. 1, the lock valve 41 is provided not in the midway of the pilot pump line 29 but in the midway of the remote-control-valve-inlet-pressure line 40 branched from the pilot pump line 29, having an open position "a" for opening the line 40 and a cutoff position "b" for cutting off the line 40 in the midway thereof to bring into communication with the tank T. In this circuit, neither of the communication selector valves 32 and 33 are brought into communication with the tank T whichever the lock valve 41 is changed at the position a or b; therefore, if the outlet-side communication selector valve of the communication selector valves 32 and 33 becomes immobilized at the pilot supply position "a" due to an occurrence of spool fixation or the like at the outlet-side communication selector valve, hydraulic fluid discharged from the hydraulic motor 11 is inevitably let to the tank T through the outlet-side communication selector valve that is immobilized at the pilot supply position in spite that the control valve 13 has been returned to the neutral position 13*a*, which makes it impossible to prevent the hydraulic motor 11 from rotation.

In contrast, in the circuit shown in FIG. 1, where the lock valve 41 is provided on respective inlet sides of the communication selector valves 32 and 33, that is, in the midway of the pilot pump line 29 in FIG. 1, the controller 42 can reliably prevent pilot pressure from being supplied to the communication valves 25 and 26 through the communication selector valves 32 and 33, by switching the lock valve 41 to the tank communication position "b" in a stewing stopped state, to hold both of the communication valves 25 and 26 at the communication cutoff position "b" regardless of the positions of the communication selector valves 32 and 33 (for example, even if any of the communication selector valves 32 and 33 is immobilized at the pilot supply position "a" due to an occurrence of spool fixation or the like) in addition to making the remote-control valve 12 inoperable, thus making prevention of the hydraulic motor 11 from rotation and holding the upper slewing body 2 in a slewing stopped state be reliable.

Figure 2:
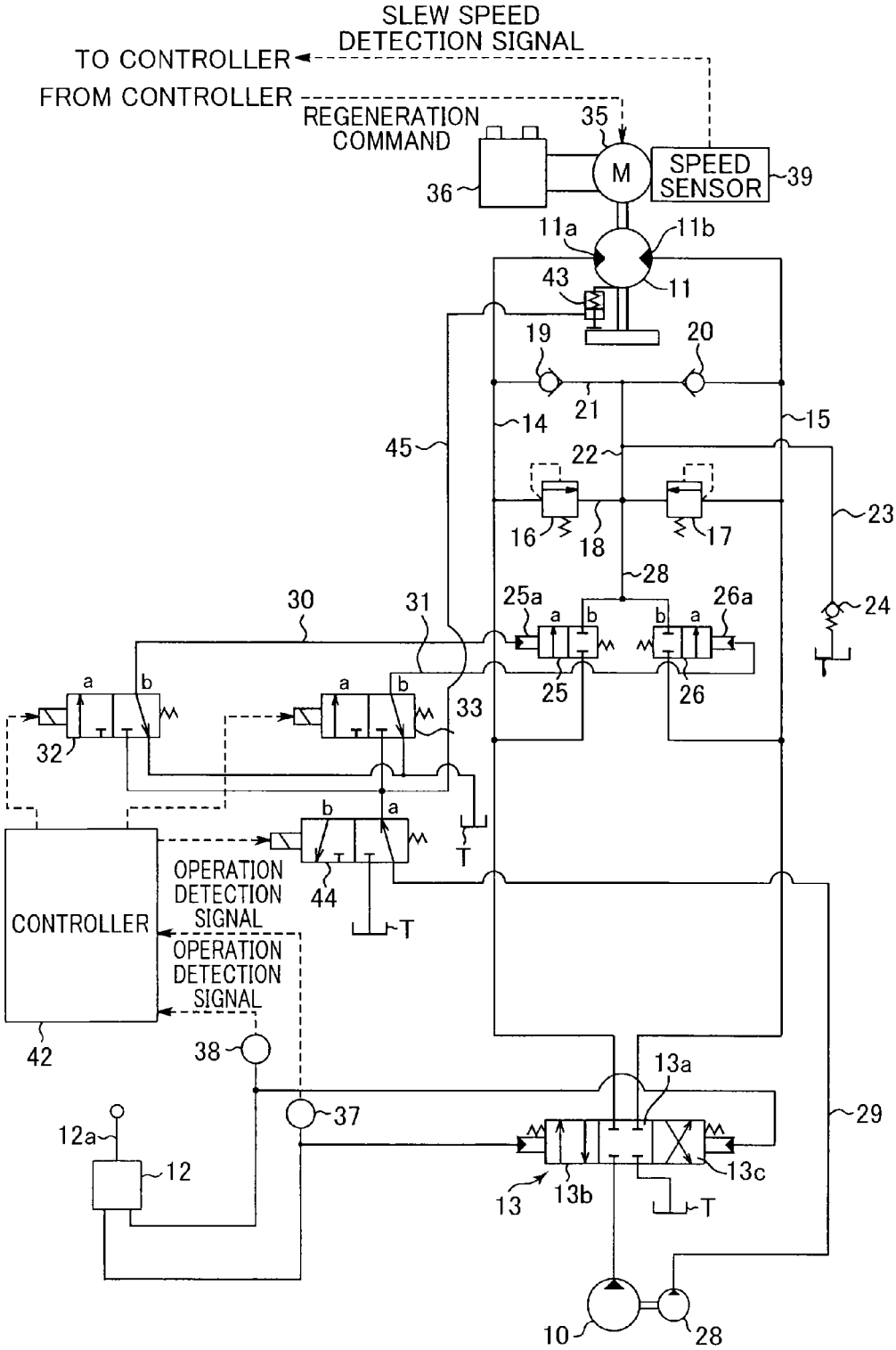
FIG. 2 is a diagram showing a hydraulic circuit according to a second embodiment of the present invention.

Next will be described a second embodiment of the present invention, with reference to FIG. 2.

The work machine according to the second embodiment comprises, in addition to the components according to the first embodiment described above, a slewing parking brake 43 which mechanically holds the upper slewing body 2 in a stopped state, and also comprises a brake control valve 44 for controlling brake actuation/brake release of the slewing parking brake 43, in place of the lock valve 41 according to the first embodiment.

The slewing parking brake 43 is switchable between a braking state of holding the upper slewing body 2 and a brake release state of releasing the holding and is configured as a negative brake which is switched to the brake release state by hydraulic pressure outputted from the pilot pump 28. In addition to the pilot pump line 29 and the first and second-communication-valve pilot lines 30 and 31 on which respective communication selector valves 30 and 31 are provided, the pilot line according to the second embodiment includes a brake line 45 branched from the pilot pump line 29 in parallel with the communication-valve pilot lines 32 and 33 and connected to the slewing parking brake 43. The slewing parking brake 43 includes a spring for applying brake force to the upper slewing body 2 in a state where no hydraulic pressure is introduced from the pilot pump 28 through the brake line 45. The hydraulic pressure is inputted to the stewing parking brake 43 so as to release the brake force of the spring against the force thereof.

Similarly to the lock valve 41 according to the first embodiment described above, the brake control valve 44 also comprises a solenoid selector valve and is provided midway of the pilot pump line 29 on the inlet side of the communication selector valves 32 and 33, and is switched to a pilot pressure supply position "a" for opening the pilot pump line 29 (in other words, a connecting position for connecting the pilot pump 28 to both of the communication selector valves 32 and 33) and a tank communication position "b" for cutting off the pilot pump line 29 midway to bring the pilot pump line 29 into communication with the tank T (in other words, a cutoff position for cutting off the pilot pump 28 from both of the communication selector valves 32 and 33) by switching command signals inputted from the controller 42.

The controller 42 issues a switching command for the brake control valve 44 based on an operation detection signal that is inputted from the pressure sensors 37 and 38. Specifically, during a slewing operation (including several seconds after a slewing stop operation has been performed) of the remote-control valve 12, the controller 42 makes the solenoid of the brake control valve 44 be non-excited to set the brake control valve 44 to the pilot pressure supply position "a", while, in a slewing stopped state, the controller 42 makes the solenoid be excited to switch the brake control valve 44 to the tank communication position "b".

In the second embodiment, where the outlet side of the brake control valve 44 is connected to the inlet side of the respective communication selector valves 32 and 33 in addition to the slewing parking brake 43, the controller 42, switching the brake control valve 44 to the tank communication position "b" in a slewing stopped state, can not only cut off the supply of hydraulic pressure to the slewing parking brake 43 to bring the slewing parking brake 43 into a brake operation state, but also reliably prevent pilot pressure from being supplied to the communication valves 25 and 26 via the communication selector valves 32 and 33 regardless of the actual positions of the communication selector valves 32 and 33. Hence, in the second embodiment, even if a situation occurs where the communication selector valves 32 and 33 become immobilized at the pilot pressure supply position "a" due to fixation of a spool or the like, it is possible, in the slewing stopped state, to prevent pilot pressure from being supplied to the communication valves 25 and 26, by the brake control valve 44, thereby holding both of the communication valves 25 and 26 at the communication cutoff position "b". Thus, similarly to the first embodiment, the hydraulic motor 11 can be prevented from rotation in spite that the control valve 13 stays at the neutral position 13*a*.

According to either of the first and second embodiments, a fail-safe function with respect to a failure attributable to fixation of a spool or the like at the communication selector valves 32 and 33 is thus exerted, which allows the upper slewing body to be reliably held in the stopped state to enhance safety.

Besides, in both of the above embodiments, the lock valve 41 and the brake control valve 44 which are solenoid selector valves for switching locking of the remote-control valve 12 or switching operations of the slewing parking brake 43 in accordance with rotation/rotation stop are utilized as switch control valves for the fail safe; this makes it possible to simplify circuit configuration and reduce facility cost, compared to a case of separately adding a dedicated switch control valve for the fail safe.

Furthermore, the lock valve 41 used as a switching control valve in the first embodiment, adapted to be switched to a non-excited state in a slewing stopped state conversely to the brake control valve 44 according to the second embodiment, can maintain the fail-safe function even if a failure such as disconnection of a solenoid occurs in the lock valve 41. This allows the safety of the work machine to be further improved.

The present invention is not limited to the first and second embodiments described above but includes embodiments as follows.

(1) While the lock valve 41 or the brake control valve 44, in the first and second embodiments described above, is used as a switching control valve, the present invention does not exclude an embodiment including a dedicated switching control valve. Alternatively, besides the lock valve 41 and the brake control valve 44, an existing solenoid selector valve which is switched to a pilot-pressure-cutoff position in a slewing stopped state, if it is provided, can be utilized as a switching control valve; this allows the configuration to be simplified, similarly to the first and second embodiment.

(2) While, in the first and second embodiments, respective communication valves 25 and 26 are provided in the left and right slewing pipe-lines 14 and 15, the present invention also includes a mode comprising a single three-position selector communication valve that is shared by both of the slewing pipe-lines 14 and 15, in place of the communication valves 25 and 26, wherein the single communication valve has a neutral position for cutting off both of the slewing pipe-lines 14 and 15 from the tank T, a left communication position for bringing the left slewing pipe-line 14 into communication with the tank while cutting off the right slewing pipe-line 15 from the tank T, and a right communication position for brining the right slewing pipe-line 15 into communication with the tank while cutting off the left slewing pipe-line 14 from the tank T.

(3) While the controller 42 according to the first and second embodiments issues a command for opening the outlet-side communication valve during driving for slewing whichever in a state of acceleration including start-up or in a state of steady operation, the controller according to the present invention may judge a state of acceleration including start-up or a state of steady operation based on an operation of the remote-control valve 12 or the like and cause the outlet-side communication valve only in one of the states to be opened. Alternatively, the controller 42 may cause the outlet-side communication valve to be opened only during slewing deceleration.

(4) The communication valve according to the present invention is not limited to one switched between the communication position "a" for brining the motor outlet-side pipe-line into communication with the tank T and the communication cutoff position "b" for cutting off the communication, as is the case of the communication valves 25 and 26, but may be one which is provided between respective pipe-lines on both sides of the motor and the control valve and switched between a communication position for bringing the pipe-lines on both sides of the motor into communication with each other, in other words, for directly interconnecting the pipe-lines on both sides of the motor, and a communication cutoff position for connecting the pipe-lines on both sides to the control valve, similarly to the direct-interconnection selector valve described in Japanese Patent Application Laid-open No. 2010-65510. Also in this case, it is preferable that: the communication valve comprises a pilot-controlled selector valve which is switched to the communication position when pilot pressure is inputted to a pilot port thereof; and the controller issues a command to the communication selector valve to switch the communication valve to the communication position to bring the outlet-side pipe-line into communication with an opposite inlet-side pipe-line at least during slewing deceleration.

(5) The slewing-type working machine according to the present invention is not limited to an excavator. The present invention may also be applied to other slewing-type working machines such as a demolition machine or a crusher which is configured by utilization of, for example, a mother body of an excavator.

As described above, the present invention provides a slewing-type working machine which is capable of improving energy recovery efficiency by reducing motor load at least during slewing deceleration, by use of a hydraulic-pilot-controlled selector valve and a communication selector valve for switching supply of pilot pressure to the hydraulic-pilot-controlled selector valve and which is capable of holding an upper slewing body in a stopped state even when a failure attributable to fixation of a spool or the like of the communication selector valve occurs. The slewing-type working machine provided by the present invention includes: a base carrier; an upper slewing body mounted on the base carrier so as to be capable of being slewed; a hydraulic motor which includes first and second ports and receives supply of hydraulic fluid through one of the first and second ports and discharges the hydraulic fluid through the other port to thereby operate so as to drive the upper slewing body to slew it; a hydraulic pump which discharges the hydraulic fluid to be supplied to the hydraulic motor; a first pipe-line; a second pipe-line; a slewing operation device including an operating member to which an operation is applied to input a command for the driving to slew and being adapted to output an operation signal corresponding to the operation applied to the operating member; a control valve connected to the first port and the second port of the hydraulic motor through the first pipline and the second pipe-line, respectively, the control valve being adapted to be operated, based on the operation signal from the slewing operation device, to control supply of hydraulic fluid to the hydraulic motor and control discharge of hydraulic fluid from the hydraulic motor and adapted to be held at a neutral position for cutting off both the first and second pipe-lines from the hydraulic pump and the tank when the operation signal is absent; a communication valve which comprises a hydraulic-pilot-controlled selector valve having a pilot port, the communication valve being adapted to be switched to a communication position for bringing a pipe-line corresponding to an outlet-side pipe-line that is the pipe-line on an outlet-side of the hydraulic motor of the first and second pipe-lines into direct communication with the tank while bypassing the control valve or communication with an inlet-side pipe-line that is the pipe-line on an inlet-side of the motor of the first and second pipe-lines when pilot pressure is supplied to the pilot port, while the communication valve being held at a communication cutoff position for cutting off the communication when the pilot pressure is not supplied to the pilot port; a communication selector valve which is provided on a pilot line for supplying pilot pressure from the hydraulic pilot pressure source to the pilot port of the communication valve and which is switched between a supply position for allowing the pilot pressure to be supplied to the communication valve and a position for cutting off the supply of the pilot pressure; a switching control valve which is provided on an inlet side of the communication selector valve and switched between a connecting position for connecting the hydraulic pilot pressure source to the communication selector valve and a cutoff position for cutting off the connection; and a controller which issues commands to the communication selector valve and the switching control valve for switching respective position of the communication selector valve and the switching control valve, wherein: at least during slewing deceleration, the controller issues a command to switch the switching control valve to the connecting position and a command to switch the communication selector valve to the supply position, thereby permitting the pilot pressure to be supplied to the pilot port of the communication valve to set the communication valve to the communication position; and, in a state where the slewing is stopped, the controller issues a command to switch the communication selector valve to the cutoff position and issues a command to switch the switching control valve to the cutoff position so as to bring the communication valve into the communication cutoff position regardless of an actual position of the communication selector valve.

In this work machine, where the controller issues a command in a slewing stopped state to switch the switching control valve to the cutoff position so as to cut off the supply of pilot pressure to the communication, even if a situation occurs where the communication selector valve becomes immobilized at the pilot pressure supply position due to fixation of a spool or the like, the supply of pilot pressure to the communication valve via the switching control valve can be reliably prevented and the communication valve can be held at the communication cutoff position. This makes it possible to prevent the hydraulic motor from rotation to cause the upper slewing body to slew in spite that the control valve is returned to the neutral position. Thus, there is exerted a fail-safe function when a failure of the communication selector valve occurs, reliably holding the upper slewing body in a stopped state regardless of an actual position of the communication selector valve, to enhance safety.

As the switching control valve according to the present invention, various selector valves that are switched in a rotation stopped state for other purposes can be utilized, as well as the specifically-provided switching control valve described earlier. Such a utilization enables circuit configuration to be simplified as compared to a case of separately adding a dedicated switching control, thus allowing facility cost to be reduced.

For example, in the case where the control valve comprises a pilot selector valve and the slewing operation device comprises a remote-control valve which inputs pilot pressure to the control valve as the operation signal, the switching control valve may be a lock valve having a connecting position for connecting the hydraulic pilot pressure source to the remote-control valve in addition to the communication selector valve and permitting supply of inlet pilot pressure from the hydraulic pilot pressure source to the remote-control valve and a cutoff position for cutting off the communication selector valve and the remote-control valve from the hydraulic pilot pressure source, and the controller may issue a command for switching the lock valve to the cutoff position when an lock lever which performs opening and closing a gate of the work machine is operated for opening. By issuing the command, the controller is enabled to prevent the supply of inlet pilot pressure from the hydraulic pilot pressure source to the remote-control valve to disable the remote-control valve from being operated, that is, to lock the remote-control valve and, at the same time, prevent pilot pressure from being supplied from the hydraulic pilot pressure source to the communication selector valve.

Specifically, the pilot line preferably includes a hydraulic-pilot-pressure-source line connected to the hydraulic pilot pressure source, a communication-valve pilot line branched from the hydraulic-pilot-pressure-source line and connected to the communication selector valve, and a remote-control-valve-inlet-pressure line branched from the hydraulic-pilot-pressure-source line and connected to the remote-control valve, wherein the lock valve is provided on the hydraulic-pilot-pressure-source line.

Besides, the lock valve preferably comprises a solenoid selector valve including a solenoid and being adapted to be held at the connecting position when the solenoid is non-excited. The lock valve comprising such a solenoid selector valve can be held at the connecting position even if a failure such as disconnection of the solenoid of the lock valve occurs to maintain a fail-safe function, thereby further improving the safety of the work machine.

Alternatively, in the case where the work machine according to the present invention comprises a slewing parking brake switchable between a braking state of holding the upper slewing body in a stopped state and a brake release state of releasing the braking and the slewing parking brake is switched from the braking state to the brake release state when hydraulic pressure is supplied to the slewing parking brake, it is also preferable that: the switching control valve is a brake control valve having a connecting position for connecting the hydraulic pilot pressure source to the slewing parking brake in addition to the communication selector valve to allow hydraulic pressure to be supplied from the hydraulic pilot pressure source to the slewing parking brake and a cutoff position for cutting off the communication selector valve and the slewing parking brake from the hydraulic pilot pressure source; and the controller issues a command for switching the brake control valve to the cutoff position in a slewing stopped state. By issuing the command, the controller can prevent the hydraulic pressure from being supplied from the hydraulic pilot pressure source to the slewing parking brake to thereby bring the slewing parking brake into a braking state and hold the upper slewing body in a stopped state and, at the same time, prevent the pilot pressure from being supplied from the hydraulic pilot pressure source to each of the switching control valves.

Specifically, it is preferable that the pilot line includes a hydraulic-pilot-pressure-source line connected to the hydraulic pilot pressure source, a communication-valve pilot line which is branched from the hydraulic-pilot-pressure-source line and connected to the communication selector valve, and a brake line which is branched from the hydraulic-pilot-pressure-source line and connected to the slewing parking brake, wherein the brake control valve is provided on the hydraulic-pilot-pressure-source line.

In the present invention, preferably included as the communication valve are: a first communication valve provided between the first pipe-line and the tank and switched between an opened position for bringing the first pipe-line into communication with the tank and a closed position for cutting off the first pipe-line and the tank from each other; and a second communication valve provided between the second pipe-line and the tank and switched between an opened position for bringing the second pipe-line into communication with the tank and a closed position for cutting off the second pipe-line from the tank. In this case, it is favorable that: the pilot line includes a hydraulic-pilot-pressure-source line connected to the hydraulic pilot pressure source, a first-communication-valve pilot line branched from the hydraulic-pilot-pressure-source line and connected to the first communication valve, and a second-communication-valve pilot line branched from the hydraulic-pilot-pressure-source line in parallel to the first-communication-valve pilot line and connected to the second communication valve; as the communication selector valve, a first communication selector valve provided on the first-communication-valve pilot line and switched between a pilot pressure supply position for opening the first-communication-valve pilot line to allow pilot pressure to be supplied to the first communication valve and a pilot pressure cutoff position for cutting off the first-communication-valve pilot line to cut off supply of the pilot pressure to the first communication valve and a second communication selector valve provided on the second-communication-valve pilot line and switched between a pilot pressure supply position for opening the second-communication-valve pilot line to allow pilot pressure to be supplied to the second communication valve and a pilot pressure cutoff position for cutting off the second-communication-valve pilot line to cut off supply of pilot pressure to the second communication valve; and the switching control valve is provided on the hydraulic-pilot-pressure-source line.

The invention claimed is:

1. A slewing-type working machine comprising:

a base carrier;

an upper slewing body mounted on the base carrier so as to be capable of being slewed;

a hydraulic motor which includes first and second ports and receives supply of hydraulic fluid through one of the first and second ports and discharges the hydraulic fluid through the other port of the first and second ports to thereby operate so as to drive the upper slewing body to slew the upper slewing body;

a hydraulic pump which discharges the hydraulic fluid to be supplied to the hydraulic motor;

a first pipe-line;

a second pipe-line;

a slewing operation device including an operating member to which an operation is applied to input a command for the driving to slew, the slewing operation device being adapted to output an operation signal corresponding to the operation applied to the operating member;

a control valve connected to the first port and the second port of the hydraulic motor through the first pipe-line and the second pipe-line, respectively, the control valve being adapted to be operated, based on the operation signal from the slewing operation device, to control supply of hydraulic fluid to the hydraulic motor and control discharge of hydraulic fluid from the hydraulic motor and adapted to be held at a neutral position for cutting off both of the first and second pipe-lines from the hydraulic pump and the tank when the operation signal is absent;

a communication valve which comprises a hydraulic-pilot-controlled selector valve having a pilot port, the communication valve being adapted to be switched to a communication position for bringing a pipe-line corresponding to an outlet-side pipe-line that is the pipe-line on an outlet-side of the hydraulic motor of the first and second pipe-lines into direct communication with the tank while bypassing the control valve or communication with an inlet-side pipe-line that is the pipe-line on an inlet-side of the motor of the first and second pipe-lines when pilot pressure is supplied to the pilot port, the communication being adapted to be held at a communication cutoff position for cutting off the communication when the pilot pressure is not supplied to the pilot port;

a hydraulic pilot pressure source which generates pilot pressure to be supplied to the communication valve;

a communication selector valve which is provided on a pilot line for supplying pilot pressure from the hydraulic pilot pressure source to the pilot port of the communication valve and which is switched between a supply position for allowing the pilot pressure to be supplied to the communication valve and a position for cutting off the supply of the pilot pressure;

a switching control valve which is provided on an inlet side of the communication selector valve and which is switched between a connecting position for connecting the hydraulic pilot pressure source to the communication selector valve and a cutoff position for cutting off the connection; and a controller which issues commands to the communication selector valve and the switching control valve for switching respective positions of the communication selector valve and the switching control valve, wherein: at least during slewing deceleration, the controller issues a command to switch the switching control valve to the connecting position and a command to switch the communication selector valve to the supply position, thereby permitting the pilot pressure to be supplied to the pilot port of the communication valve to set the communication valve to the communication position; and, in a state where the slewing is stopped, the controller issues a command to switch the communication selector valve to the cutoff position and issues a command to switch the switching control valve to the cutoff position so as to bring the communication valve into the communication cutoff position regardless of an actual position of the communication selector valve.

2. The slewing-type working machine according to claim 1, wherein: the control valve comprises a pilot selector valve and the slewing operation device comprises a remote-control valve which inputs pilot pressure to the control valve as the operation signal; the switching control valve is a lock valve having a connecting position for connecting the hydraulic pilot pressure source to the remote-control valve in addition to the communication selector valve to allow inlet pilot pressure to be supplied from the hydraulic pilot pressure source to the remote-control valve and a cutoff position for cutting off the communication selector valve and the remote-control valve from the hydraulic pilot pressure source; and the controller issues a command for switching the lock valve to the cutoff position when an lock lever which performs opening and closing a gate of the work machine is operated for opening.

3. The slewing-type working machine according to claim 2, wherein the pilot line includes a hydraulic-pilot-pressure-source line connected to the hydraulic pilot pressure source, a communication-valve pilot line branched from the hydraulic-pilot-pressure-source line and connected to the communication selector valve, and a remote-control-valve-inlet-pressure line branched from the hydraulic-pilot-pressure-source line and connected to the remote-control valve, wherein the lock valve is provided on the hydraulic-pilot-pressure-source line.

4. The slewing-type working machine according to claim 2, wherein the lock valve comprises a solenoid selector valve including a solenoid and being adapted to be held at the connecting position when the solenoid is non-excited.

5. The slewing-type working machine according to claim 1, further comprising a slewing parking brake switchable between a braking state of holding the upper slewing body in a stopped state and a brake release state of releasing the braking, wherein: the slewing parking brake is switched from the braking state to the brake release state when hydraulic pressure is supplied to the slewing parking brake; the switching control valve is a brake control valve having a connecting position for connecting the hydraulic pilot pressure source to the slewing parking brake in addition to the communication selector valve to allow hydraulic pressure to be supplied from the hydraulic pilot pressure source to the slewing parking brake and a cutoff position for cutting off the communication selector valve and the slewing parking brake from the hydraulic pilot pressure source; and the controller issues a command for switching the brake control valve to the cutoff position in a slewing stopped state.

6. The slewing-type working machine according to claim 5, wherein the pilot line includes a hydraulic-pilot-pressure-source line connected to the hydraulic pilot pressure source, a communication-valve pilot line branched from the hydraulic-pilot-pressure-source line and connected to the communication selector valve, and a brake line branched from the hydraulic-pilot-pressure-source line and connected to the slewing parking brake, and wherein the brake control valve is provided on the hydraulic-pilot-pressure-source line.

7. The slewing-type working machine according to claim 1, wherein: as the communication valve, a first communication valve provided between the first pipe-line and the tank and switched between an opened position for bringing the first pipe-line into communicated with the tank and a closed position for cutting off the first pipe-line from the tank and a second communication valve provided between the second pipe-line and the tank and switched between an opened position for bringing the second pipe-line into communication with the tank and a closed position for cutting off the second pipe-line from the tank are included; the pilot line includes a hydraulic-pilot-pressure-source line connected to the hydraulic pilot pressure source, a first-communication-valve pilot line branched from the hydraulic-pilot-pressure-source line and connected to the first communication valve, and a second-communication-valve pilot line branched from the hydraulic-pilot-pressure-source line in parallel to the first-communication-valve pilot line and connected to the second communication valve; as the communication selector valves, a first communication selector valve provided on the first-communication-valve pilot line and switched between a pilot pressure supply position for opening the first-communication-valve pilot line to allow pilot pressure to be supplied to the first communication valve and a pilot pressure cutoff position for cutting off the first-communication-valve pilot line to cut off supply of pilot pressure to the first communication valve and a second communication selector valve provided on the second-communication-valve pilot line and switched between a pilot pressure supply position for opening the second-communication-valve pilot line to allow pilot pressure to be supplied to the second communication valve and a pilot pressure cutoff position for cutting off the second-communication-valve pilot line to cut off supply of pilot pressure to the second communication valve; and the switching control valve is provided on the hydraulic-pilot-pressure-source line.

* * * * *